US005454569A

United States Patent [19]

Walker

[11] Patent Number: 5,454,569

[45] Date of Patent: Oct. 3, 1995

[54] AFRO AMERICAN EDUCATIONAL QUIZ GAME

[76] Inventor: Donald P. Walker, 12728 Larchmere Apt E, Cleveland, Ohio 44120

[21] Appl. No.: 378,083

[22] Filed: Jan. 25, 1995

Related U.S. Application Data

[63] Continuation-in-part of Ser. No. 298,832, Aug. 31, 1994, abandoned.

[51] Int. Cl.[6] ..... A63F 3/00

[52] U.S. Cl. ..... 273/236; 273/431; 273/432; 434/154

[58] Field of Search ..... 273/236, 249–254, 273/243, 256, 430–432, 296

[56] References Cited

U.S. PATENT DOCUMENTS

| | | | |
|---|---|---|---|
| 387,220 | 8/1888 | Forker | 273/296 |
| 4,998,735 | 3/1991 | Blackwell | 273/249 |
| 5,085,439 | 2/1992 | Lott | 273/236 |
| 5,087,050 | 2/1992 | Donovan | 273/237 |
| 5,248,147 | 9/1993 | Smith | 273/244 |
| 5,257,939 | 11/1993 | Robinson | 273/236 |

*Primary Examiner*—Benjamin H. Layno
*Attorney, Agent, or Firm*—Carson, James E.

[57] ABSTRACT

The invention relates to an Afro American Educational Quiz Game where players receives points for correctly identifying notable black persons on question and answer cards. The game has a game board divided into multiple subject categories with letters for each category and numbers corresponding to letters and numbers on the question and answer cards and token chips, which are kept in a card box, having separate compartments for each subject matter and a chip box with separate compartments for each category. A person chosen as monitor places the numbered and lettered chips on the correspondingly matched numbered and lettered sections of the game board. A player then chooses a category. The monitor then selects a chip from the category chosen by the player, and the monitor picks the question and answer card corresponding to the number and letter on the selected chip. The question and answer card has a mini biography of a notable black person on one side and a photograph of the notable black person on the other side. The player who corectly identifies the notable black person accumulates points until all the cards are retired.

10 Claims, 4 Drawing Sheets

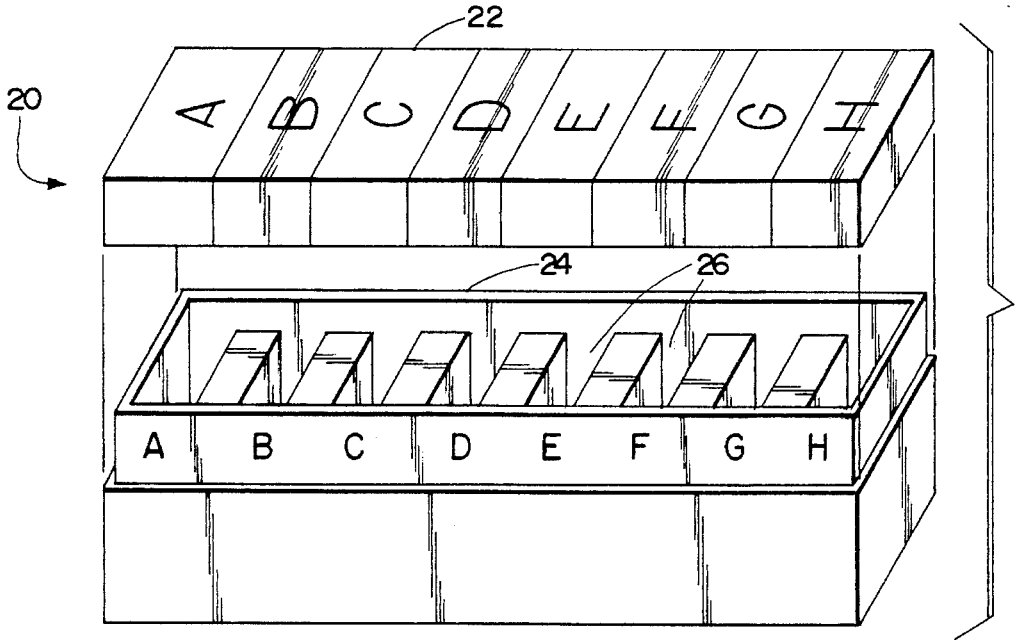
Fig. 3
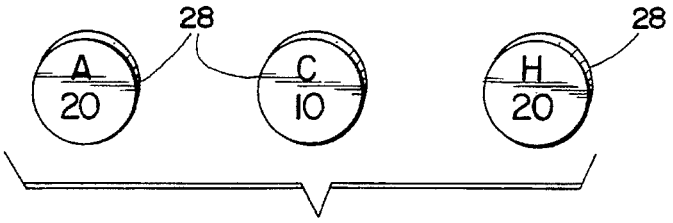
Fig. 4
Fig. 5
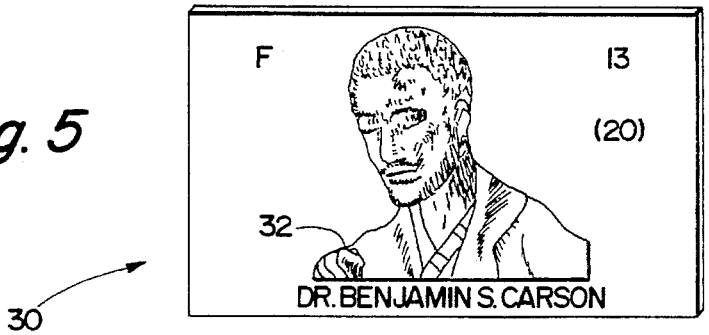
Fig. 6
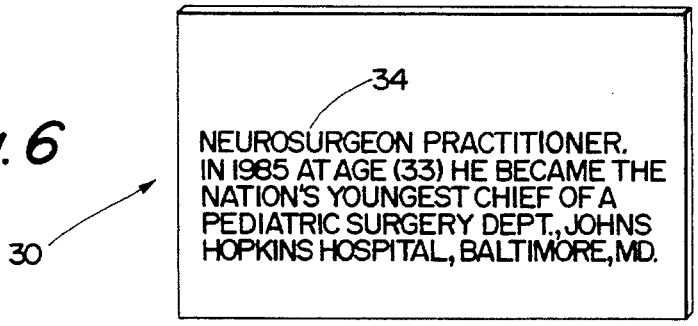

AFRO AMERICAN EDUCATIONAL QUIZ GAME

This is a continuation-in-part of application Ser. No. 08/298,832 filed on Aug. 31, 1994, now abandoned.

FIELD OF INVENTION

The invention relates to educational and recreational game apparatus and more particularly relates to African American History Games directed to educating and enlightening the general public on the contribution and achievement of black persons in various fields.

It is only one of the objectives of this invention to educate, motivate, encourage black youths on the contribution to American culture made by their forefathers heretofore not taught or mentioned in traditional elementary, middle and high school cirriculum.

It is another object of this invention to increase our youth understanding of great African American leaders in society and there achievements.

Another object is to provide an efficient inexpensive educational quiz game on notable African Americans simple enough so that minor young children can participate and still remain challenging to grownups. Very few educational recreational quiz games relates to African American History. Prior art black history games are too complicated for young black youths.

The psychologist, Dr. Kenneth Clark, one of Americas foremost African American social scientist, and as a result of his extensive report of the dysfunctional behavior of adolescent blacks, concluded that the loss of self-esteem and self-worth of young blacks was as a result of institutionalized racism. Further Dr. Clark's studies revealed that the lack of black history contributions in school cirriculums adversely affected an adolescent throughout adulthood. The loss of self-esteem is manifest in our society today as shown by the dysfunctional beehavior displayed throughout our urban communities.

PRIOR ART

Prior art recreational, educational board games such as U.S. Pat. No. 5,121,928 deals with movies and movie titles and various categories of entertainment.

Ford U.S. Pat. No. 4,884,816 patented Aug. 15, 1989, discloses a recreational game utilizes questions and answers card. The Ford Patent requires an erasable slate for writing answers and a spin dial to select the category.

The Begley U.S. Pat. No. 4,856,780, patented Mar. 28, 1988, recreational game is directed to sports trivia and utilizes dice to move token on the game board.

The Madlock U.S. Pat. No. 4,984,805, patented Jan. 26, 1990, utilizes a game board with progress path for players and a rotable spindle to select the questions.

The Lott U.S. Pat. No. 5,085,439, patented Feb. 12, 1991, discloses a game board requiring plurality of multi-colored squares superimposed over a map of Africa.

Other Patent of interest to show the state of the art are Donovan U.S. Pat. No. 5,087,050, O'Neil U.S. Pat. No. 4,889,345.

The aforementioned Patents each utilize game boards and methods of play in which cards are used. However, the configuration to the game board of this application is unique. The questions, answers, scoring, method of play, subject matter are different from those previously patented.

BRIEF SUMMARY OF INVENTION

The invention comprises an African American Educational Quiz Game in which the player selects a category from a game board having multiple subject categories. A person chosen as the monitor places the numbered and lettered chips on the correspondingly matched numbered and lettered sections of the game board. A player then chooses a category by selecting a chip from the category chosen.

The monitor then pulls query card from a card box which has the same corresponding number and letter on the selected chip and game board and reads the mini biography on the card identifying the notable black person. The player is allowed thirty (30) seconds to identify the notable black person based on their achievements in the mini biography. If the player correctly identifies the notable person the player then receives the amount of score points listed on the card. Score points are awarded for correct answers. Twenty (20) points are awarded by the monitor, for each correct answer. If the player dosen't correctly identify the notable black person on the card, the next player in line is given a chance to identify the notable black person. The player receives score point if he correctly identifies the notable black person. If he fails to correctly identify the notable black person the monitor will pass the question to the next player and through the entire panel of players until the question is correctly answered. Players may play as teams or individually.

If the question is not answered by any of the players the monitor will reveal the correct answer and retire the card and chip out of play. The monitor will show the player the photograph and name of the notable black person. The game also can be played by first showing the photograph of the notable black person. The player gets points for correctly identifying the photograph.

The person who accumulates the most points wins the game. The game will last until the entire two hundred (200) game cards have been presented.

BRIEF DESCRIPTION OF THE DRAWINGS

FIG. 3 is an exploded perspective view of the card box.

FIG. 4 is a perspective view of the chips.

FIG. 5 is a perspective view of the back side of the question and answer card.

FIG. 6 is a perspective view of the front side of the question card.

DETAILED DESCRIPTION OF THE INVENTION

Figure 1:
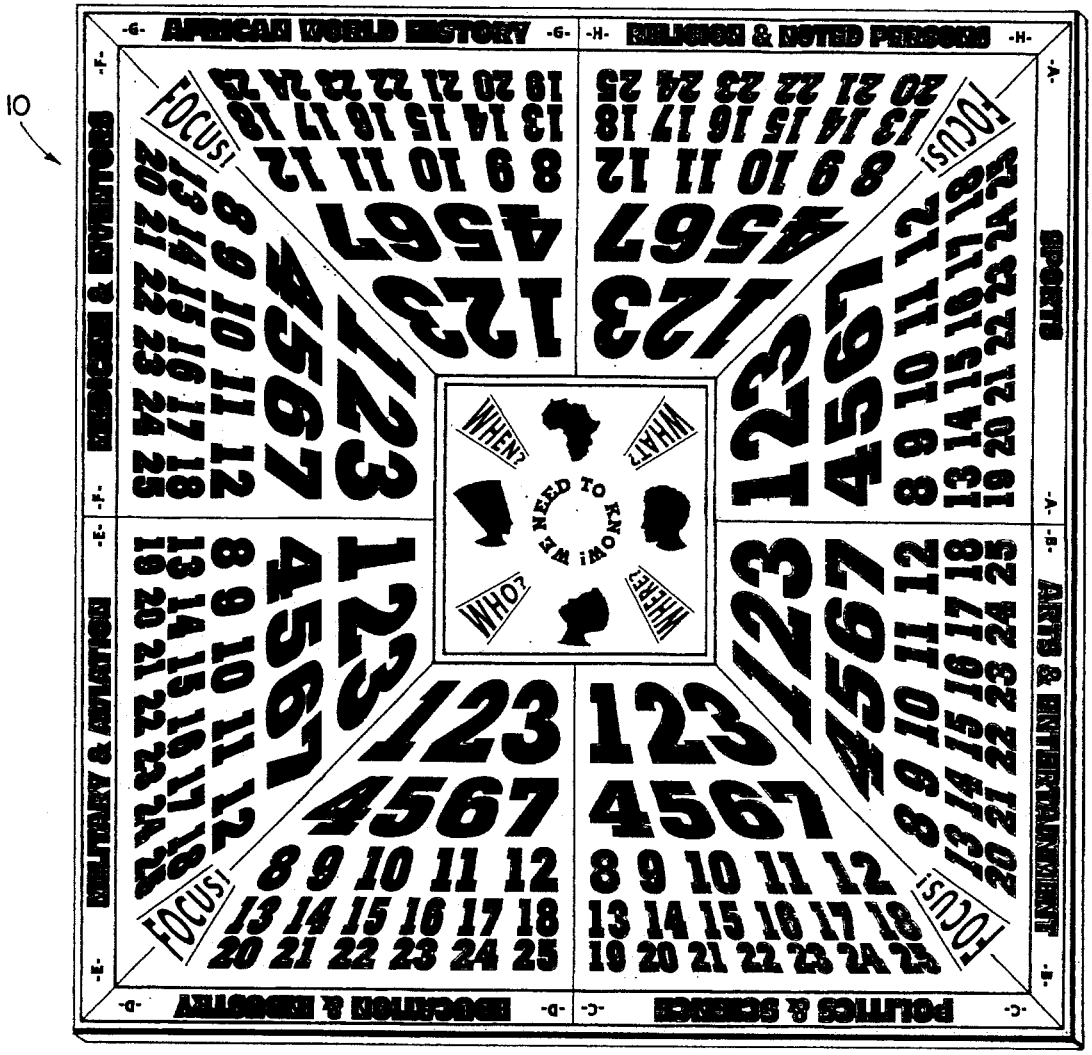
FIG. 1 is a top elevational view of the game board of the present invention.

The Afro American Quiz Game comprises a game board (FIG. 1) having multiple categories identified by letters and numbers for players selections.

The game board is divided into eight (8) sections with numbers 1–25 for each lettered section category. The game board is flat rectangular shaped, although others shapes can be used as long as it is divided into eight (8) sections for the eight (8) categories of subject matter.

Figure 8:
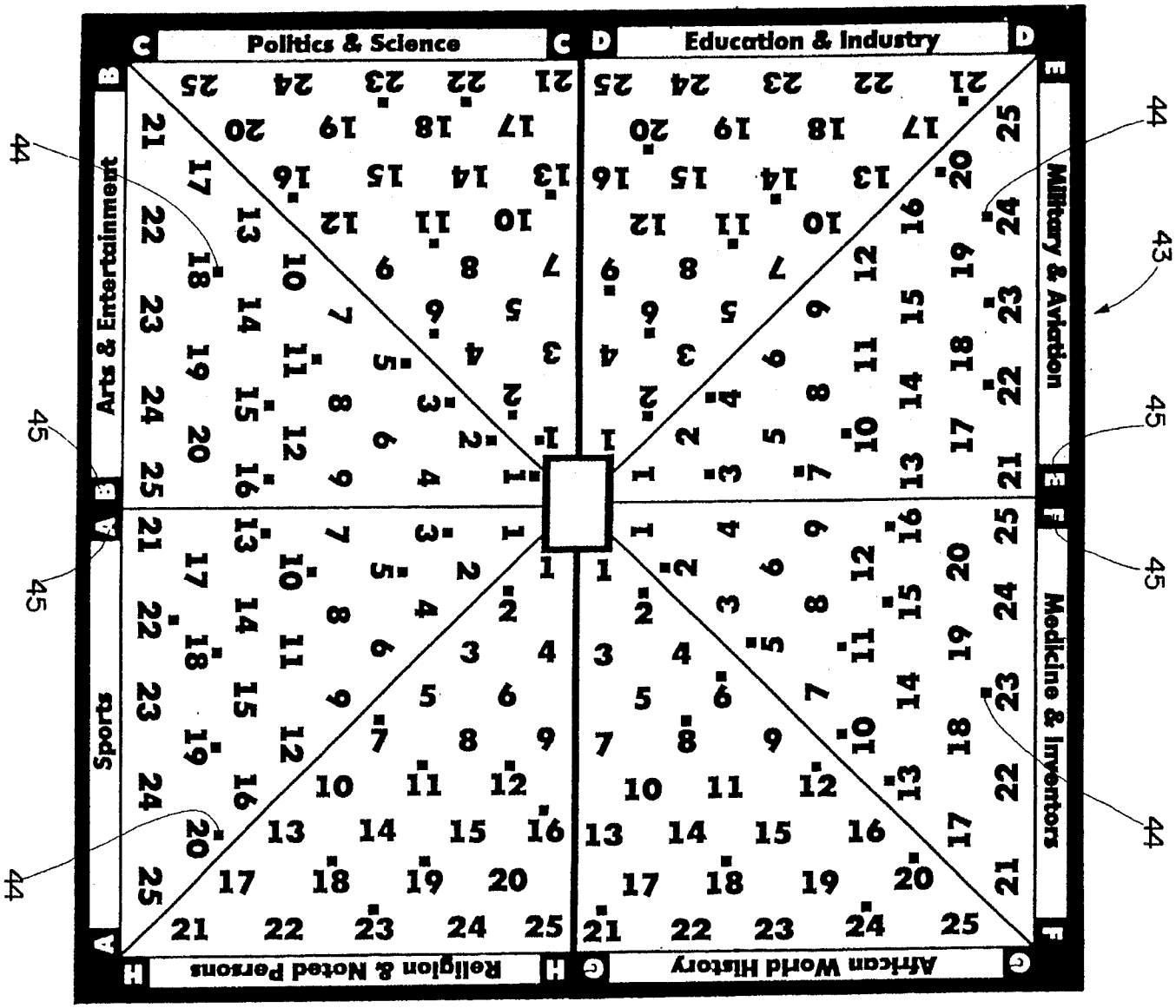
FIG. 8 is a top elevational view of another version of the game board.

The game board (FIG. 1) is divided into eight (8) categories by subject matter for player selection. As indicated by the letters A thru H. The categories are (a) sports (b) arts and entertainment (c) politics and science (d) education and industry (e) military and aviation (f) medicine and inventors (g) african world history, and (h) religion and noted person. Each category on the board list 1–25 numbered African American persons of historical distinctions. The object of the game is to identify the notable black person for their achievement. Another version of the game board (FIG. 8) has a symbol (44) to designate bonus points for certain characters in each category (45) more difficult to identify.

A NOTABLE BLACK PERSON IS SOMEONE WHO IS ACCOMPLISHED IN THEIR FIELD OF ENDEAVOR, SUCH AS

CATEGORY (A) SPORTS

George Branham, III—First Afro-American professional bowling champion.

Lynette Woodard—All star, highest scoring, collegiate basketball player.

Isaac Murphy—Most famous Afro-American horse racing jockey, Hall of Fame.

CATEGORY (B) ART & ENTERTAINMENT

Edmonia Lewis—First Afro-American female to be recognized nationally as a sculptor.

Euzhan Palcy—First Afro-American female director of a full length movie for a major hollywood studio.

Ferdinand Morton—Famous pianist/composer/blue/jazz music innovator.

CATEGORY (C) POLITICS & SCIENCE

Ida B. Wells Barnett—Journalist and anti-lynching civil rights crusader.

Shirley Chisholm—First Afro-American female elected to the United States Congress.

Dr. Kenneth B. Clark—Educator and most prominent psychologist and behaviorial social scientist.

CATEGORY (D) EDUCATION & INDUSTRY

Dr. Mary H. Futrell—Three term president of the National Educational Association.

Dr. Jewel P. Cobb—Educator, biologist and President Emeritus, of the University of California.

David Llyod—Founder of the largest ever black owned ship building company in the United States.

CATEGORY (E) MILITARY & AVIATION

Dr. Guion S. Bluford—First Afro-American male to travel into space.

Lt. Commander Evelyn Fields—First Afro-American female to command a United States navel ship.

Dr. Ronald McNair—A physicist and crew member on board the 1986 Space Mission Challenger disaster.

CATEGORY (F) MEDICINE & INVENTORS

Dr. Benjamin S. Carson—Neurosurgeon practitioner. In 1985 he became one of the nation's youngest chiefs of a Pediatric Neurosurgery Dept. John Hopkins Hospital, Baltimore, Md.

Dr. Theodore K. Lawless—Dematoligist, educator and world wide known skin specialist.

Dr. Jane C. Wright—A surgeon. She advanced the technique of chemotherapy treatment for cancer.

CATEGORY (G) AFRICAN WORLD HISTORY

General Hannibal Barca—A citizen of Carthage, the Phonician Metropolis of North Africa. He led his soldiers across the Alps into Rome.

Angie Brooks Randolph—Political activist and first African female to serve as president of the U.N. General Assembly.

Yaa Asantewaa—Queen mother of the Ashanti Nation of West Africa. An heroic freedom fighter.

CATEGORY (H) RELIGION & NOTED PERSONS

Bishop Vinton R. Anderson—In 1991 he was the first ever Afro-American selected President of the World Council of Churches.

Rev. Leon Sullivan—Civil Rights crusader. In 1964 he founded the Opportunities Industializations Center of America. (OIC).

Bishop Barbara C. Harris—In 1989 she became the first female ever elected an Anglican-Bishop of the Protestant Episcopal Church.

Rev. Pauli Murray—Lawyer, educator, author and dynamic civil rights activist.

The aforesaid list is not exclusive but only a representative sample the game has two hundred notable persons listed on the cards, photographic images or sketches can be used.

Additional notable black persons can be added and delected as needed.

Figure 7:
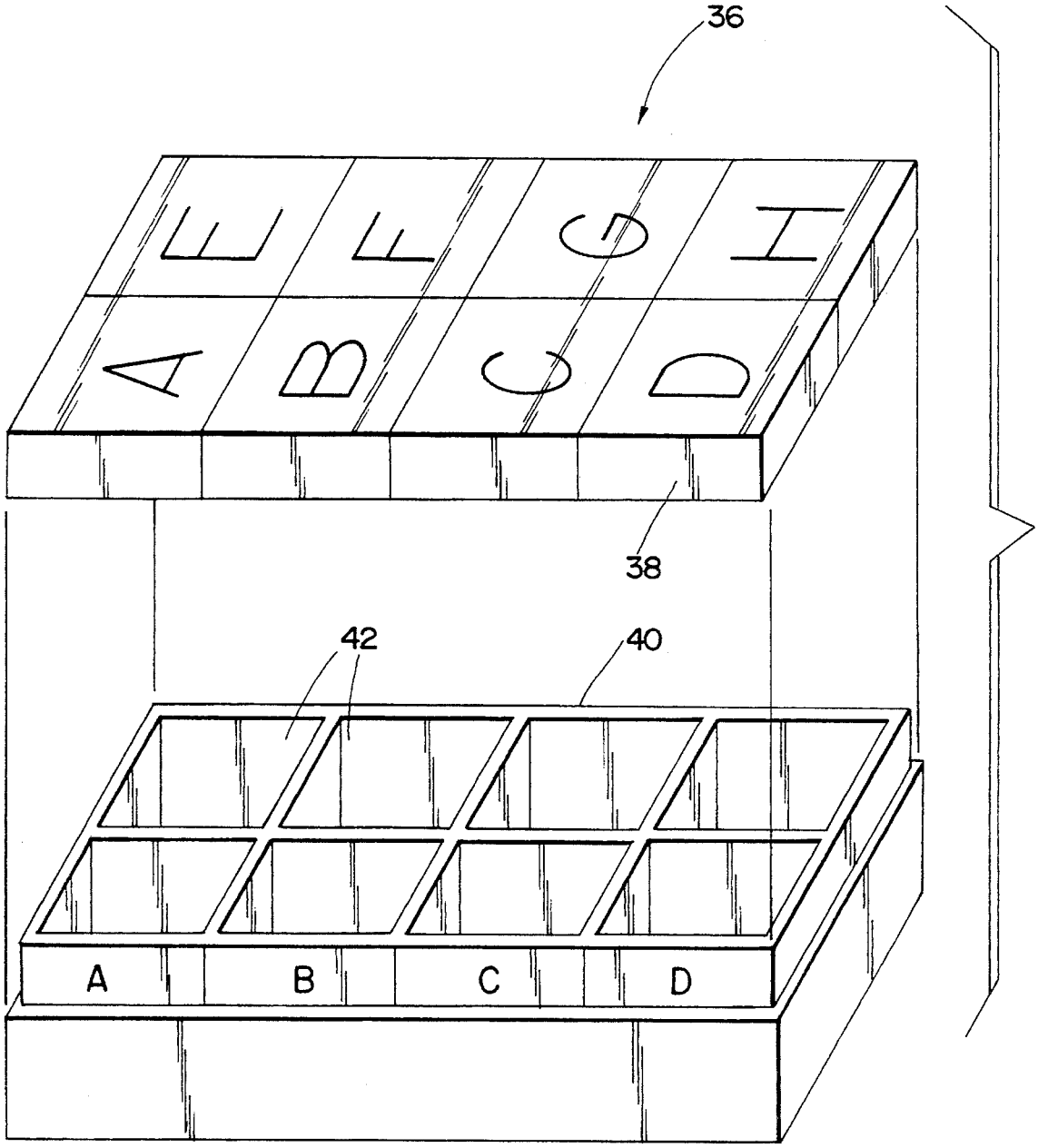
FIG. 7 is a perspective view of a rectangular shaped chip box.

The chip box (16) is an elongated box shaped with horizontal slots situated vertically in the chip box to form separate compartments (42) for each category can be used. The chip box (16) has a cover (12) that fits flush over the chip box bottom. Another version of chip box (FIG. 7) having a rectangular shape and top cover (36).

The chip box can be elongated (16) or rectangular (40) with eight (8) compartments (reference number 42) placed four (4) across and two (2) deep. See FIG. 7.

The token chips (28) are circular in shape and are placed in the separate compartments in the chip box. Although rectangular shapes can be used. The token chip can be made of any suitable material such as paper, plastic or metal and can be luminescent, although metal is perferred. The token chips (28) have numbers and letters on each side corresponding to the category and number of the notable black person on the game board and on the question and answer cards (30). The token chips (28) have letters and numbers corresponding to the letters and numbers on the game board (reference number 10 in FIG. 1).

Figure 2:
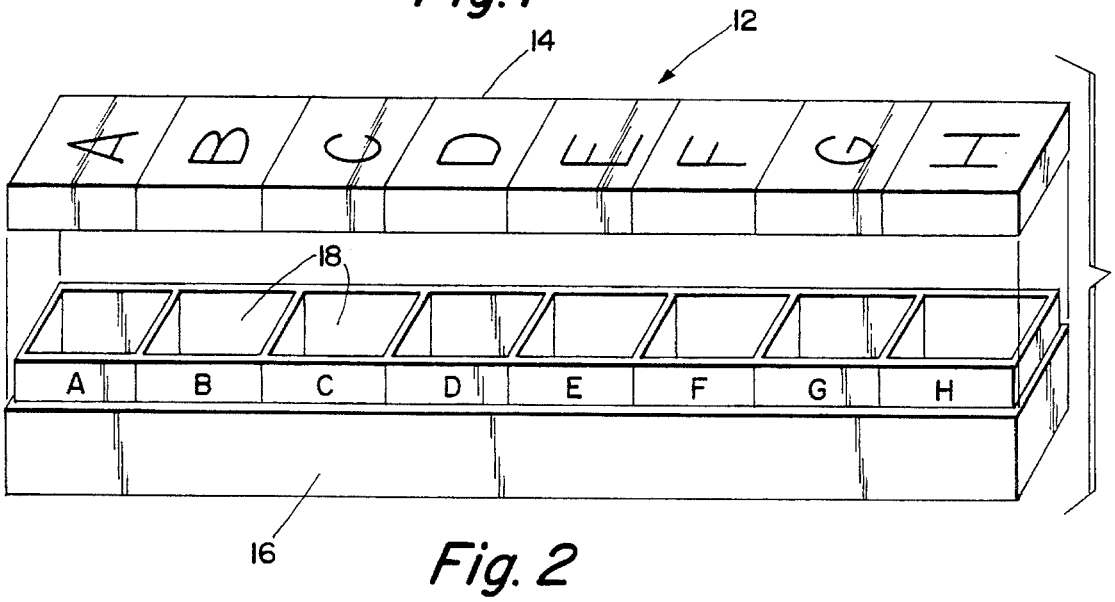
FIG. 2 is an exploded perspective view of the chip box.

Another component of the quiz game is a card box (reference number 24 in FIG. 3) to hold the question and answer cards. The card box is elongated rectangular shaped box with separate compartments (26) for each category of question and answer cards. Other shaped boxes can be used as long as they have separate compartments (26) for each category. The card box (FIG. 2) has a bottom portion and a top cover (22) that fits snuggly over the bottom portion (24). The query cards must be kept separate in the card box according to category subject matter to keep the game moving promptly.

The card box can be made from paper, cardboard, wood, plastic and metal, preferable waterproof material.

The card box has letters for each category printed on the bottom portion and top portion for quick location and placement of cards.

The card box (24) has separate compartments (26) vertically placed across the box for easy storage and access of the cards (FIG. 3). The card box (24) has separate compartments for various subject matters and categories. The card box is provided with a card box cover (22) to protect the cards. The query and answer cards (30) are stored in the card box (24).

The game is played by a person acting as a monitor who removes the numbered and lettered chips (28) from the chip box (16) and places them on the correspondingly matched numbered and lettered sections of the game board. The players play individually or in teams. Each player or team one at a time chooses a category. The monitor then randomly selects a chip (16) from the category chosen by the player or team. The monitor also picks the a question and answer card (30) having a number and a letter corresponding to the selected chip (16). The monitor either show the player or team the photograph of the notable black person on the card and/or reads the mini-biography of the notable black person on the card in order to give a clue to the player or team.

The monitor controls the game and gives the player thirty (30) seconds to answer the question. The player or team receives the points indicated on the card for correctly identifying the notable black person. If the player or team does not correctly identify the notable black person, the next player or team in line is given a chance to identify the notable black person. If the question is not answered by any of the players or teams the monitor will reveal the correct answer and retire the card and the corresponding chip out of play. A player may receive bonus points for difficult questions which are designated on the game board by a symbol or star symbol next to the character number (see FIG. 8). The monitor will record scores for each players bonus points. Bonus points can also be identified on the chips. The game will last until the entire two hundred game cards have been presented and all the chips have been removed form the board. The player or team which accumulates the most points win the game. The object of the game is too identify the notable black person for their achievements.

I claim:

1. An Afro American Educational Quiz Game wherein the players receive points for correctly answering the questions Comprising:

a) A game board having a playing surface divided into a plurality of sections, each section comprising a subject category and a letter representing the subject category, the subject category and letter in each section being different, each section comprises a plurality of numbers listed in numerical sequence;

b) A plurality of question and answer cards each subject category having a plurality of question and answer cards, each card having a mini biography on one side to identify a notable black person and on the other side having a photograph of the notable black person with a number and a letter to correspond to the number and subject category letter; on the game board, wherein each of the numbers in each category is represented by a question and answer card and also, each card having score points for correctly identifying the notable black person;

c) A plurality of game chips, each game chip having a number and a letter corresponding to a number and a subject category letter on the game board and answer cards wherein each of the numbers in each category is represented by a game chip;

d) A chip box to hold said chips, having separate compartments for each category of questions on the game board for the game player to select a chip; and e) A card box to hold the question and answer card having separate compartments for each subject category on the game board.

2. The Afro American Educational Quiz Game of claim 1 wherein the game board is flat rectangular shaped and foldable and the card box has letters for each subject category corresponding to the letters on the game board.

3. The Afro American Educational Quiz Game of claim 2 wherein the separate compartments in the chip box has letters to correspond with the subject category on the game board.

4. The Afro American Education Quiz Game of claim 2 wherein the card box has a cover to fit over the card box.

5. The Afro American Educational Quiz Game of claim 2 wherein the game board has eight (8) subject categories with 1 to 25 numbers in each subject category.

6. The Afro American Educational Quiz Game of claim 2 wherein the chip box has a cover that fits over the chip box.

7. The Afro American Educational Quiz Game of claim 6 wherein the card box and chip box are made from waterproof material such as plastic, wood, metal and cardboard.

8. Afro American Educational Recreational Quiz Game of claim 2 wherein the game board has symbols near the character numbers to designate bonus questions.

9. The Afro American Educational Quiz Game of claim 1 wherein the card box has a rectangular square shape.

10. The Afro American Educational Quiz Game of claim 1 wherein the game board is divided into subject categories of Politics and Science, Arts and Entertainment, Sports, Education and Industry, Military and Aviation, Medicine and Inventors and African World History.

* * * * *